US005734958A

United States Patent [19]

Kazama et al.

[11] Patent Number: 5,734,958

[45] Date of Patent: Mar. 31, 1998

[54] IMAGE FORMING APPARATUS COMPRISING CONTROL MEANS FOR FEEDING A COPY SHEET BASED ON THE LENGTH OF AN ORIGINAL DOCUMENT

[75] Inventors: Hiroatsu Kazama; Akira Kurimoto, both of Ebina, Japan

[73] Assignee: Fuji Xerox Co., Ltd., Tokyo, Japan

[21] Appl. No.: 745,839

[22] Filed: Nov. 8, 1996

[30] Foreign Application Priority Data

| | | | |
|---|---|---|---|
| Nov. 10, 1995 | [JP] | Japan | 7-293042 |
| Nov. 10, 1995 | [JP] | Japan | 7-293043 |
| Nov. 8, 1996 | [JP] | Japan | 8-296838 |

[51] Int. Cl.[6] ..... G03G 15/00

[52] U.S. Cl. ..... 399/363; 271/3.15; 399/370; 399/391

[58] Field of Search ..... 399/38, 363, 370, 399/376, 388, 391; 271/3.14, 3.15, 3.16, 9.01, 9.06

[56] References Cited

U.S. PATENT DOCUMENTS

| | | | |
|---|---|---|---|
| 5,118,089 | 6/1992 | Yamada et al. | 271/3.16 |
| 5,197,723 | 3/1993 | Yamada et al. | 271/3.15 |
| 5,223,905 | 6/1993 | Yamada et al. | 399/370 |
| 5,317,372 | 5/1994 | Nakabayashi et al. | 399/370 |
| 5,333,043 | 7/1994 | Yamada | 271/3.15 X |
| 5,347,352 | 9/1994 | Morigami et al. | 399/363 |

FOREIGN PATENT DOCUMENTS

| | | |
|---|---|---|
| A-5-94069 | 4/1993 | Japan . |
| A-6-255839 | 9/1994 | Japan . |

*Primary Examiner*—Arthur T. Grimley
*Assistant Examiner*—Sophia S. Chen
*Attorney, Agent, or Firm*—Oliff & Berridge, P.L.C.

[57] ABSTRACT

An image formation apparatus for transferring an image of an original document to a copy paper sheet. Original documents are placed in an original document tray and copy paper sheets are stored in a paper tray. The original document tray has a tray sensor for sensing the original document placed on the original document tray. Upon transferring the original documents to an image scanning apparatus, a regi-sensor measures the length of the original document when the original document is transported to the scanning apparatus. A value corresponding to a transport distance is stored until the original document leaves the tray sensor based on the length of the original document. The tray sensor can sense when the original document is transported more than the transport distance corresponding to the value stored. Paper is fed out of the copy paper sheet tray to the image transfer apparatus when the controller senses the original document.

7 Claims, 8 Drawing Sheets

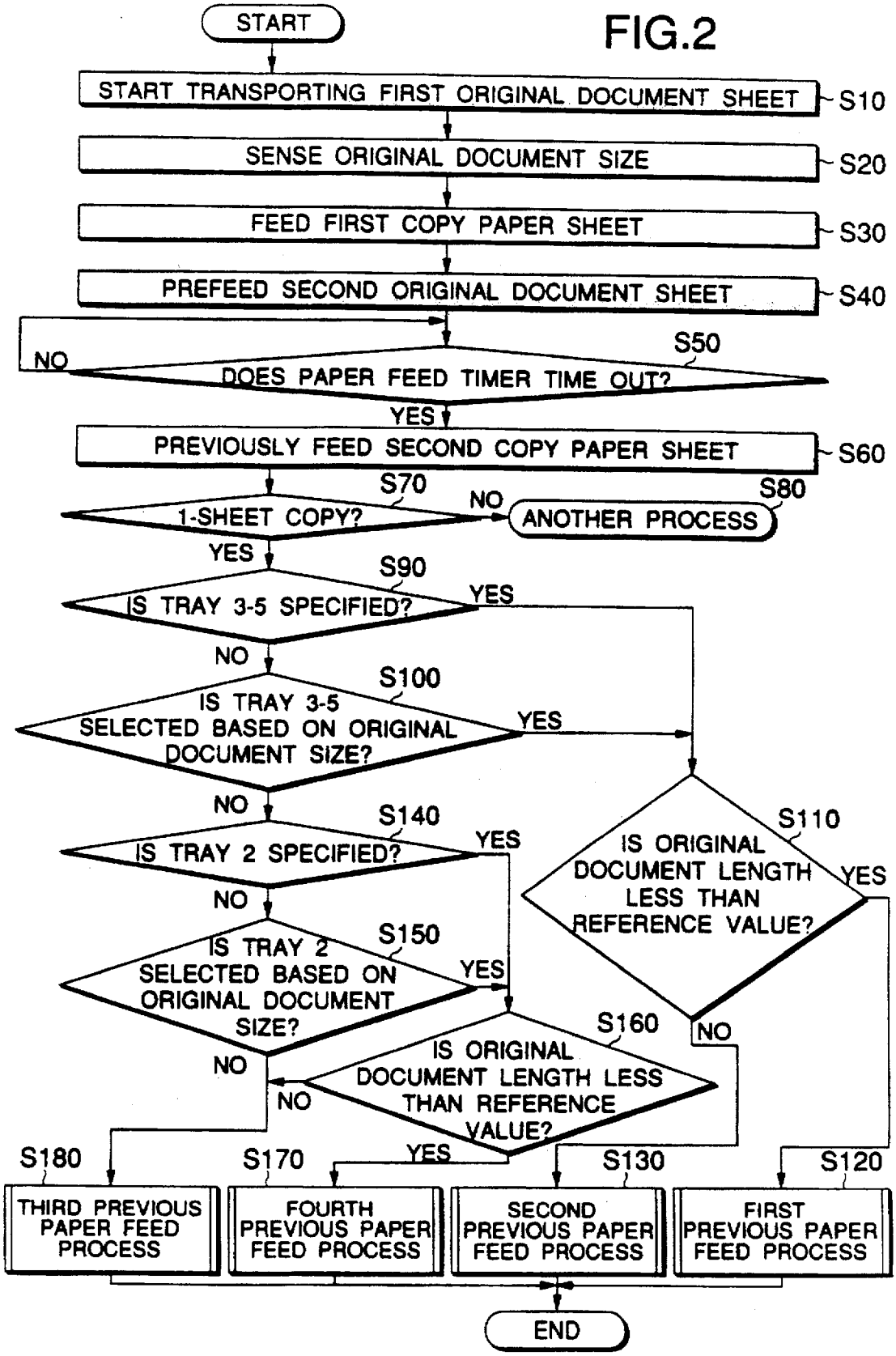
FIG.2
START
START TRANSPORTING FIRST ORIGINAL DOCUMENT SHEET
S10
SENSE ORIGINAL DOCUMENT SIZE
S20
FEED FIRST COPY PAPER SHEET
S30
PREFEED SECOND ORIGINAL DOCUMENT SHEET
S40
S50
DOES PAPER FEED TIMER TIME OUT?
NO
YES
PREVIOUSLY FEED SECOND COPY PAPER SHEET
S60
S70
1-SHEET COPY?
NO
S80
ANOTHER PROCESS
YES
S90
IS TRAY 3-5 SPECIFIED?
YES
NO
S100
IS TRAY 3-5 SELECTED BASED ON ORIGINAL DOCUMENT SIZE?
YES
NO
S140
IS TRAY 2 SPECIFIED?
YES
NO
S110
IS ORIGINAL DOCUMENT LENGTH LESS THAN REFERENCE VALUE?
YES
NO
S150
IS TRAY 2 SELECTED BASED ON ORIGINAL DOCUMENT SIZE?
YES
NO
S160
IS ORIGINAL DOCUMENT LENGTH LESS THAN REFERENCE VALUE?
NO
YES
S180
THIRD PREVIOUS PAPER FEED PROCESS
S170
FOURTH PREVIOUS PAPER FEED PROCESS
S130
SECOND PREVIOUS PAPER FEED PROCESS
S120
FIRST PREVIOUS PAPER FEED PROCESS
END

IMAGE FORMING APPARATUS COMPRISING CONTROL MEANS FOR FEEDING A COPY SHEET BASED ON THE LENGTH OF AN ORIGINAL DOCUMENT

BACKGROUND OF THE INVENTION

This invention relates to an image formation apparatus comprising an automatic original document feeder (ADF) and, in particular, to an image formation apparatus which can speed up a copy cycle for copying a sheet of paper out of each original document.

A recent copier as an example of an image formation apparatus has an automatic original document feeder (ADF) in addition to an optical system and a paper feed section of copy paper. The automatic original document feeder feeds an original document one sheet at a time from an original document tray and transports it to an image read position on platen glass. After an image is read, the automatic original document feeder discharges the original document. It automatically performs the operation, thereby accelerating the copy speed. The paper feed section transports copy paper from a paper tray to an image transfer section in synchronization with transport of the original document by the automatic original document feeder. To make copies out of a 1-sheet original document, as many sheets of copy paper as the specified number of copies are fed out one at a time from the paper tray at given time intervals, thereby enhancing productivity.

However, to make a copy out of a 1-sheet original document, the next sheet of copy paper cannot be fed out from the copy paper feed section until a check is made to ensure that the next original document exists. A recent copy paper feed section comprises three to four paper feed trays. Since the transport passage from the top tray to an image transfer section is short, copy paper can be fed at a pitch at which the highest productivity is provided. However, since the transport passage from the bottom tray to the image transfer section is long, it takes long time until the previously fed sheet of copy paper arrives at the image transfer section. Therefore, if a check is made to ensure that the next original document exists before the next sheet of copy paper is fed, a delay results and copy productivity drops. Then, a method is proposed, for example, in the Unexamined Japanese Patent Application Publication Nos. Hei. 5-94069 and 6-255839, wherein a sensor, called a tray sensor, is placed at a position on an original document tray where sensor output goes off when an original document is prefed for sensing the third sheet of original document counted from the original document on platen glass. According to this method, a sheet of copy paper corresponding to the third original document sheet can be fed out from the paper tray.

However, if an original document is long, tray sensor output does not go off at the prefeed time. Thus, if an original document is long, copy paper cannot be fed out earlier. If the tray sensor is placed upstream so that tray sensor output at the prefeed time goes off although an original document is long, a short original document does not cover the tray sensor although it is not prefed. Thus, a short original document as the third original document sheet cannot be sensed.

Since a sensor disposed upstream from a tray is prone to malfunction due to a warped original document, an operator's hand shade, etc., if copy paper is fed out based on output of the tray sensor, unnecessary copy paper may be fed or copy paper may be unable to be fed.

Further, a jam may occur by the time an original document on the tray arrives at platen glass. In this case, the sheet of copy paper corresponding to the third original document sheet must be discharged; copy paper is wasted.

SUMMARY OF THE INVENTION

It is therefore an object of the invention to provide an image formation apparatus that can solve the above-mentioned problems.

To the end, according to the invention (aspect 1), there is provided an image formation apparatus comprising an image transfer means for transferring an image of an original document to a copy paper sheet, an original document tray for placing the original document, a paper tray for storing the copy paper sheet, a tray sensor for sensing the original document placed on the original document tray, means for transporting the original document to a scanning means, a regi sensor for measuring the length of the original document when the original document is transported to the scanning means, means for storing a value corresponding a transport distance until the original document leaves the tray sensor based on the length of the original document, means for sensing the original document by the tray sensor when the original document is transported more than the transport distance corresponding to the value stored in the storage means, and means for feeding out the copy paper sheet to the image transfer means from the paper tray when the sensing means senses the original document.

In the configuration (aspect 2), the image formation apparatus as in aspect 1 further comprises means for prefeeding the original document on the original document tray to a point before the scanning means, means for determining whether or not the original document has a size covering the tray sensor when the original document is prefed, based on the length of the original document, and means for sensing the original document by the tray sensor after the original document is prefed if the prefed original document has a size not covering the tray sensor.

In the configuration (aspect 3), the image formation apparatus as in aspect 2 further comprises means for sensing the original document by the tray sensor after the prefed original document is transported to the scanning means if three original document sheets cannot be fed between the paper tray and the scanning means.

In the configuration (aspect 4), the image formation apparatus as in any of aspects 1 to 3 further comprises means for feeding out the copy paper sheet when the regi sensor senses the original document if the original document is a small-size original document that cannot be sensed by the tray sensor.

According to the invention (aspect 5), there is provided an image formation apparatus comprising an image transfer means for transferring an image of an original document to a copy paper sheet, an original document tray for placing the original document, a paper tray for storing the copy paper sheet, a tray sensor for sensing the original document placed on the original document tray, and means for transporting the original document to the scanning means, wherein the original document is sensed based on relationship between a position of the tray sensor and sensing timing of the tray sensor.

According to the invention (aspect 6), there is provided an image formation apparatus comprising an image transfer means for transferring an image of an original document to a copy paper sheet, an original document tray for placing the original document, a paper tray for storing the copy paper sheet, a tray sensor for sensing the original document placed on the original document tray, means for transporting the original document to the scanning means, tray sensor monitor means for monitoring whether or not output of the tray sensor changes between the instant when power is turned on and the instant when a copy is started, and transport control means for setting transport timing of the transport means without being concerned with output of the tray sensor if output of the tray sensor does not change at all between the instant when power is turned on and the instant when a copy is started or for setting transport timing of the transport means based on output of the tray sensor if output of the tray sensor changes between the instant when power is turned on and the instant when a copy is started.

According to the invention (aspect 7), there is provided an image formation apparatus comprising an image transfer section for transferring an image of an original document to copy paper, a plurality of paper trays for storing copy paper, a plurality of transport passages each for transporting copy paper from each of the paper trays to the image transfer section, means for selecting one paper tray out of the paper trays, and an automatic original document feeder for detecting as many original document sheets as the number of sheets of copy paper existing on the transport passage of the paper tray selected by the selection means.

In the invention (aspect 8), in the image formation apparatus as in aspect 7, the automatic original document feeder has means for measuring the length of the original document, and the number of original document sheets is determined based on the length of the transport passage and the length of the original document.

BRIEF DESCRIPTION OF THE DRAWINGS

FIG. 2 is a flowchart to show a selection method of a previous paper feed of process of copy paper;

DETAILED DESCRIPTION OF THE PREFERRED EMBODIMENTS

Referring now to the accompanying drawings, there is shown one preferred embodiment of the invention.

Figure 1:
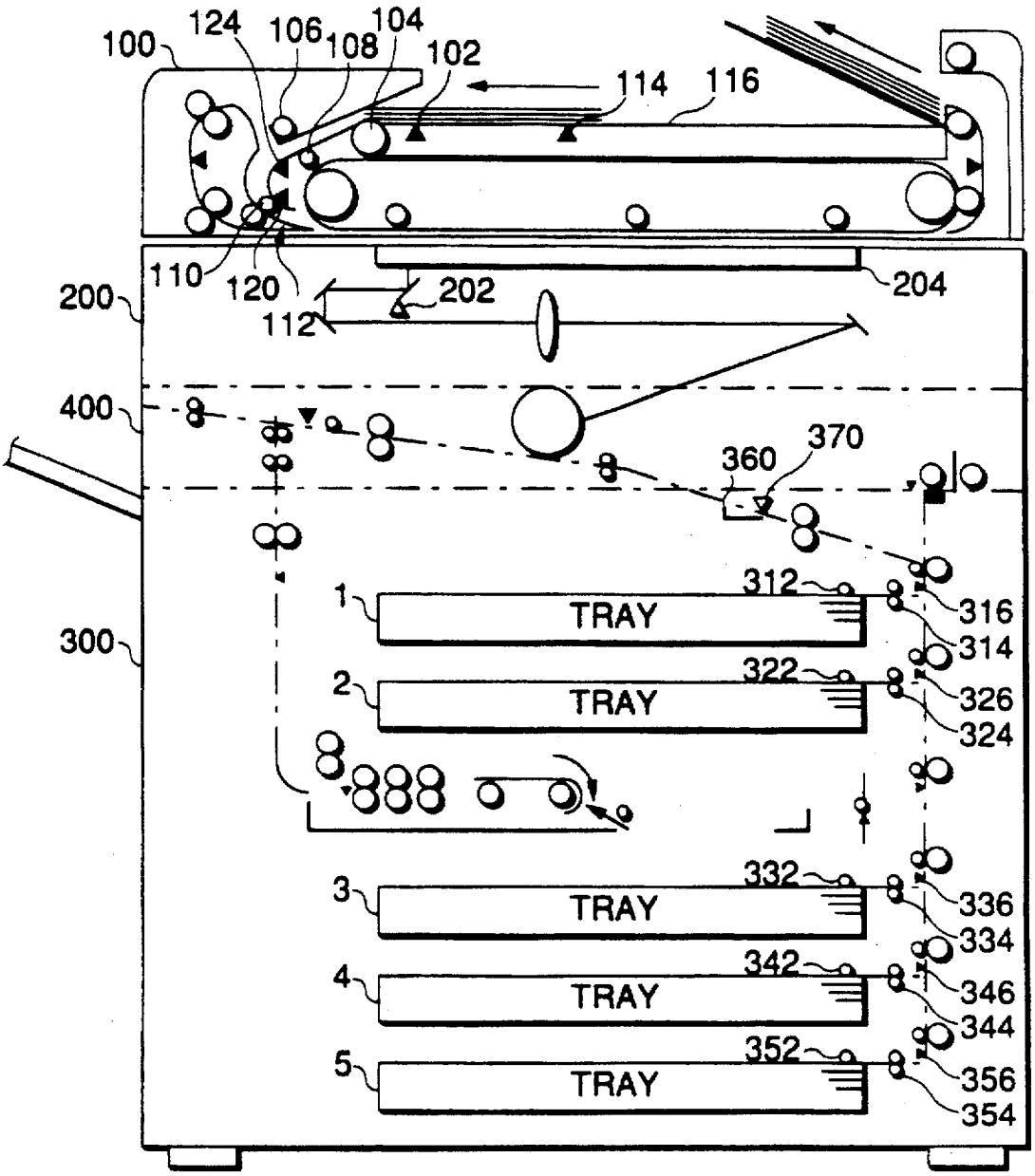
FIG. 1 is an illustration to show the configuration of a copier as an embodiment of the invention.

1. Mechanical configuration:

FIG. 1 shows the configuration of a copier to which the invention is applied. The copier has an automatic original document feeder (ADF) 100, an optical system 200, an image transfer section 400, and a paper feed section 300.

The automatic original document feeder 100 has an original document set sensor 102 for sensing an original document set on an original document tray 116, a calling-in roller 104 connected to a feed motor (not shown), a separation roller 106 for separating a sheet from a bundle of original document sheets, and a transport roller 108 for transporting a called-in original document. When an original document is sensed by the original document set sensor 102 disposed near the calling-in roller 104 and a start button is pressed, the calling-in roller 104 calls in the original document.

The separation roller 106 positioned above the transport roller 108 separates a sheet from a bundle of original document sheets. The separated original document sheet is furthermore transported by the transport roller 108 and strikes a nip zone 112 of a take-away roller 110 which stops, wherein the original document sheet warps and skew is corrected. This operation is called prefeed. The original document sheet which has been prefed is transported onto platen glass 204 and the optical system 200 reads an image of the original document sheet. An optical system regi sensor 202 detects the optical system 200 being placed at a predetermined position.

On the original document tray 116, a tray sensor 114 is disposed upstream from the original document set sensor 102. If an original document of a predetermined length or more is placed on the original document tray 116, it covers the tray sensor 114, turning on output of the tray sensor 114. The shortest length of an original document turning on the tray sensor 114 is determined by the position of the tray sensor 114. In the embodiment, when an original document of B5 size or more within the standard size is set, the tray sensor 114 outputs on. An original document of less than the predetermined length does not cover the tray sensor 114 at the prefeed position. Thus, the tray sensor 114 goes off in a state in which prefeed of the final original document is complete. The maximum length of an original document turning off output of the tray sensor 114 at the prefeed time is determined by the position of the tray sensor 114 and the original document move distance. In the embodiment, when an original document of A4 size or less within the standard size is prefed, the tray sensor 114 outputs off.

The paper feed section 300 has paper trays 1 to 5 on which copy paper is placed. The paper trays 1 to 5 transport copy paper one sheet at a time to the image transfer section 400 by separation means 312, 322, 332, 342, and 352 and transport means 314, 324, 334, 344, and 354 respectively. Paper feed sensors 316, 326, 336, 346, and 356 for detecting copy paper are disposed downstream from the paper feed means of the paper feed trays. Placed before the image transfer section 400 are a regi gate 360 and a regi sensor 370 for correcting skew of copy paper and matching the transfer timing with the optical scanning timing.

2. Copy operation:

A flowchart in FIG. 2 shows an outline of the copy operation. When the start button is pressed, if the original document set sensor 102 senses an original document, the automatic original document feeder 100 prefeeds the original document and starts transporting the original document onto the platen glass 204 by the take-away roll 110 at step S10. While the original document is transported onto the platen glass 204, the original document size is sensed at step S20. At this time, the original document length is sensed by an original document regi sensor 120 positioned upstream from the take-away roller 110.

A. To sense the original document length, the time during which the regi sensor continues on is measured, the measurement time is multiplied by the original transport speed, and which original document reference value range the multiplication result is contained in is determined.

The original document width is sensed by two size sensors 124 disposed near the original document regi sensor 120 in a direction perpendicular to the original document running direction.

Original Length Sensing Table

| Original | Original length | Sensing reference value |
|---|---|---|
| A4SEF | 297 | 288–312 |
| B5SEF | 257 | 242–267 |
| A5SEF | 210 | 195–225 |
| A5LEF | 148 | 133–163 |

Next, a paper tray is selected based on operator's input. However, if the operator does not select any paper tray, a tray on which copy paper of the same size as the original document is placed is selected. Once the original document size is determined, the paper feed section starts transporting the first sheet of copy paper at step S30. The original document size is sensed based only on the first original document sheet. For the second and later original document sheets, copy paper is fed from the paper tray used for the first copy, wherein the second and later sheets of copy paper can be fast fed out from the paper tray. Transported copy paper is sensed by the sensor 370 and stops at the regi gate 360.

When the original document being transported onto the platen glass 204 passes through the regi sensor 120, namely, when the regi sensor 120 is turned off and the rear end of the original document is sensed, if the original document set sensor 102 senses the next original document, the automatic original document feeder 100 prefeeds this original document at step S40.

The optical system 200 starts scanning according to AND logic of the automatic original document feeder 100 completing transport of the original document onto the platen glass 204 and the copy paper arriving at the sensor 316. When the optical system 200 starts scanning, in synchronization with scanning of the optical system 200, copy paper is transported from the regi gate 360 to the image transfer section 400 for transferring an image. When the optical system 200 terminates scanning, a scanning end signal is transmitted to the automatic original document feeder 100, which then transports the prefed original document onto the platen glass 204. The copy paper onto which the image is transferred is then discharged.

To use the tray 1 or 2, the paper feed section 300 sets a paper feed timer when copy paper arrives at the sensor 316. To use the tray 3, 4, or 5, the paper feed section 300 sets the paper feed timer when copy paper arrives at the sensor 336 placed downstream from the tray 3. When the paper feed timer counts a predetermined value at step S50, since the second original document sheet exists, the second copy paper sheet is previously fed at step 56O.

Next, whether or not a copy from a one-sided original document sheet to one side of one copy paper sheet is to be made is determined at step 57O. If the determination at step S70 is NO, control goes to step S80 (another process). To make a copy from a one-sided original document sheet to one side of one copy paper sheet, control proceeds to step S90.

3. Paper feed start time of second and later sheets of copy paper:

3.1 Paper feed start time when tray 3, 4, or 5 is selected:

If the operator specifies tray 3, 4, or 5 at step S90 or tray 3, 4, or 5 is selected based on the original document size at step S100, control goes to step S110. The distance from the tray 3, 4, or 5 to the regi gate 360 is long. Thus, when the original document sheet is short and the resultant scanning time of the optical system 200 is short, by the time the next original document sheet is sensed and a copy paper sheet is fed, the copy paper sheet does not arrive at the regi gate 360 by the time the sensed next original document sheet arrives at the platen glass 204. To prevent the productivity from being lowered, it is necessary to sense the original document as soon as possible and previously feed copy paper. Then, whether or not the original document length is less than the reference value is determined at step S110. If the original document length is less than the reference value, the first previous paper feed process for sensing the third original document sheet and previously feeding copy paper is executed at step S120.

Figure 3:
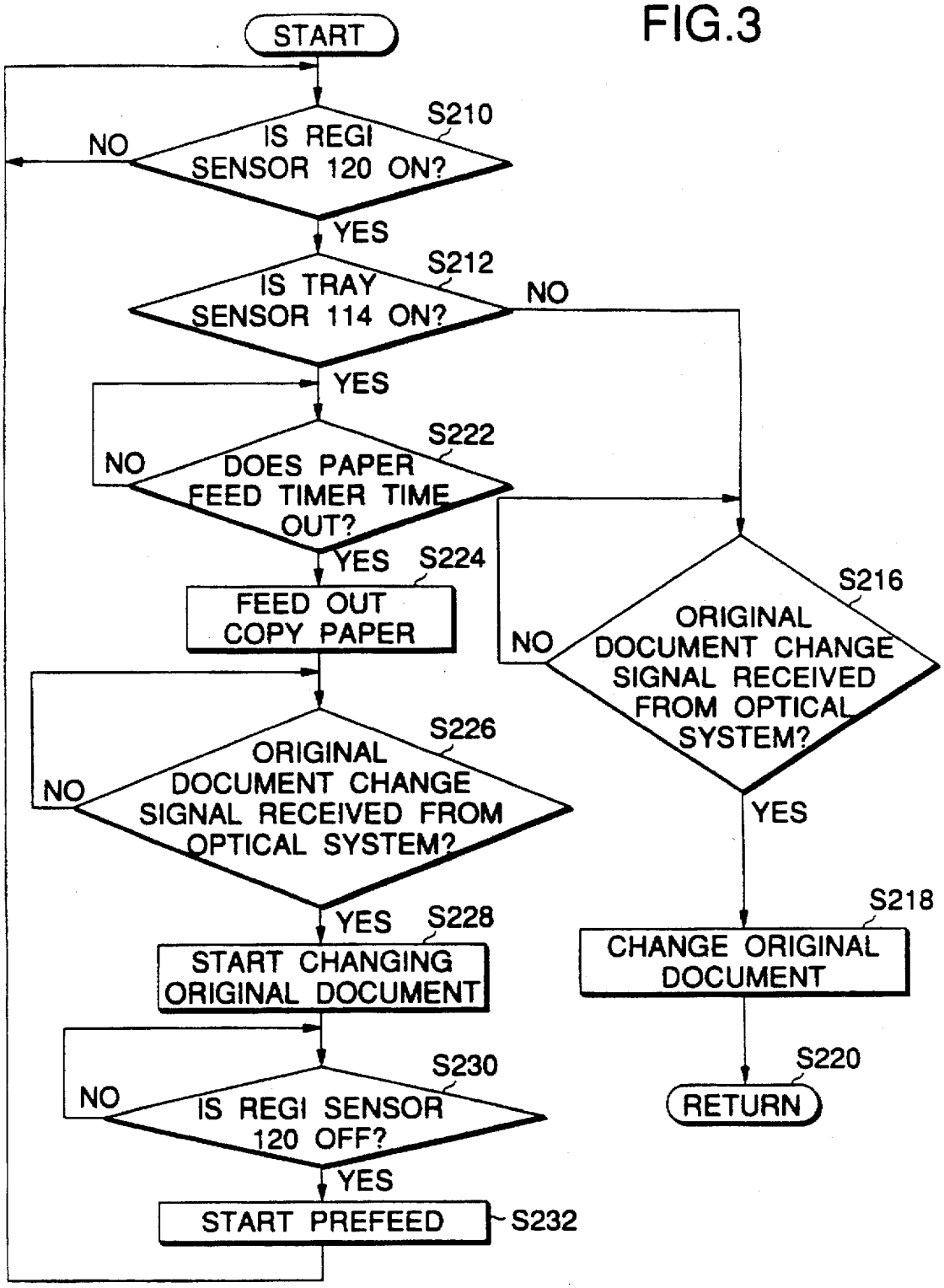
FIG. 3 is a flowchart to show details of a first previous paper feed process (S120) in FIG. 2.
Figure 4:
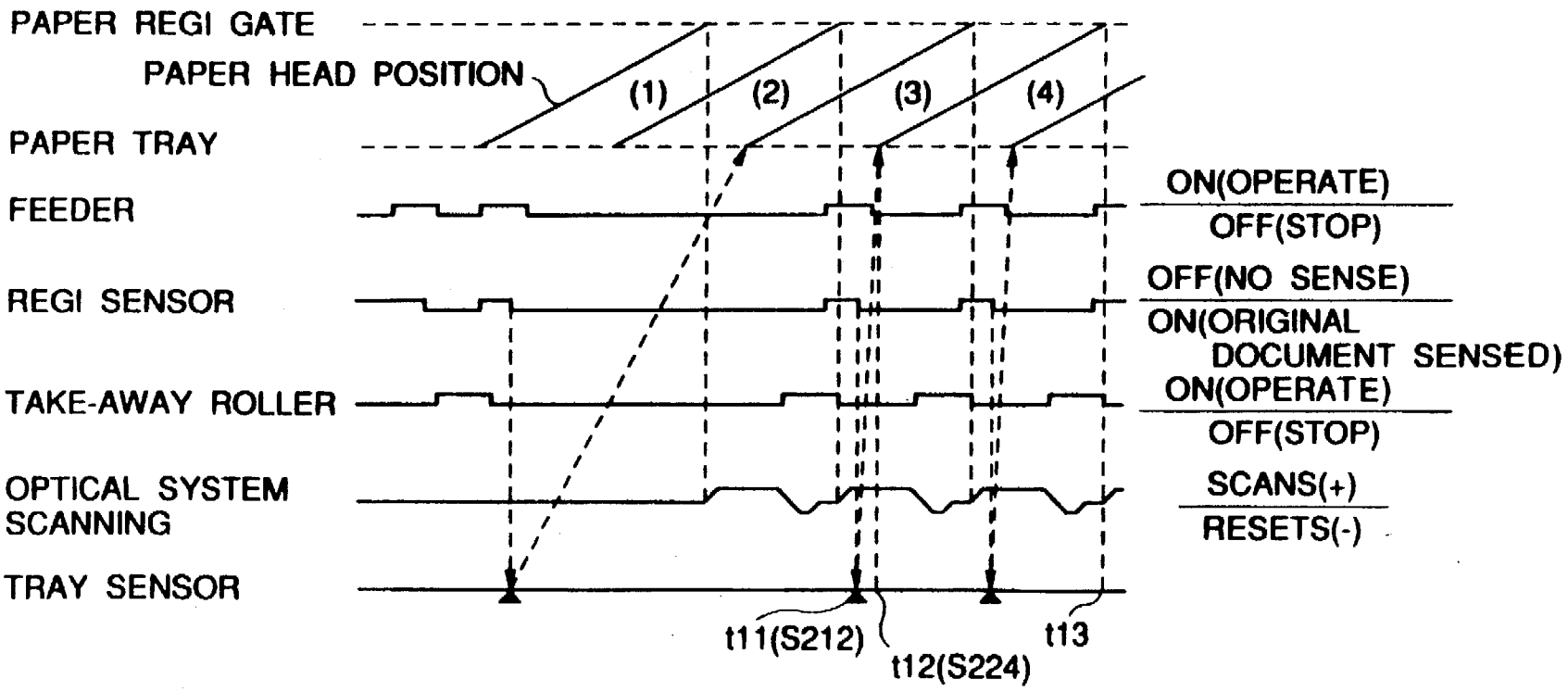
FIG. 4 is an illustration to show copy paper feed timing when the first paper feed process is executed.

FIG. 3 shows details of the first previous paper feed process (step S120). FIG. 4 shows the copy paper feed timing when the first previous paper feed process is executed. In FIG. 4, (1) to (4) indicate processing of first to fourth copy paper sheets respectively. The paper head position indicates the front end position of copy paper. The feeder and the take-away roller 110 operate when high (1), and stop when low (0). When the regi sensor 120 senses an original document, it is on, namely, low (0); when the regi sensor 120 does not sense an original document, it is off, namely, high (1). When the optical system scanning signal is plus, the optical system 200 moves in the scanning direction; when the optical system scanning signal is minus, the optical system 200 moves in the opposite direction. Output of the tray sensor 114 is sensed when it is indicated by an arrow in the figure.

In FIGS. 3 and 4, first control stands by until the original document regi sensor 120 outputs on, namely, the automatic original document feeder 100 completes prefeed at step S210. Upon completion of the prefeed, the tray sensor 114 senses whether or not an original document exists at step S212 (t11). Since the first original document sheet is on the platen glass 204 and prefeed of the second original document sheet is complete, the tray sensor 114 senses the third original document sheet. If the tray sensor 114 senses no original document, a wait loop is initiated for an original document change signal to come from the optical system 200 at step S216 until the already pre-fed original document is transported onto the platen glass 204 at step S218, then control returns at step S220.

When copy paper arrives at the paper feed sensor 336 placed downstream from the paper tray 3, the paper feed section 300 starts counting the paper feed timer. If the tray sensor 114 outputs on at step S212, copy paper corresponding to the third original document sheet is previously fed at step S224 (t12), provided that the paper feed timer has counted a predetermined value at step S222. As seen in FIG. 4, the copy paper sheet corresponding to the third original document sheet is previously fed based on output of the tray sensor 114, wherein the copy paper sheet arrives at the regi gate 360 by the time the take-away roller 110 transports the original document onto the platen glass 204 (t13), wherein a copy can be made without producing the wait time in the paper transport section. A wait is made for an original document change signal to come from the optical system 200 at step S226, and original document change is started at step S228. When the regi sensor 120 goes off (S230), prefeed is started (S232).

The third original document sheet can be sensed only if an original document of the size turning off output of the tray sensor 114 at the prefeed completion (S232). If an original document longer than the size, such as a B4SEF or A3SEF original document, is set, the third original document sheet cannot be sensed at the prefeed completion. When an original document transported onto the platen glass 204 passes through the original document sensor 120, if the next original document is sensed and then a copy paper sheet is fed out, the copy paper sheet does not arrive at the regi gate 360 from the tray 5 by the time the sensed original document arrives at the platen glass 204. Then, if the original document length is more than the size turning off output of the tray sensor 114 at the prefeed completion at step S110, the following second previous paper feed process is performed at step S130.

Figure 5:
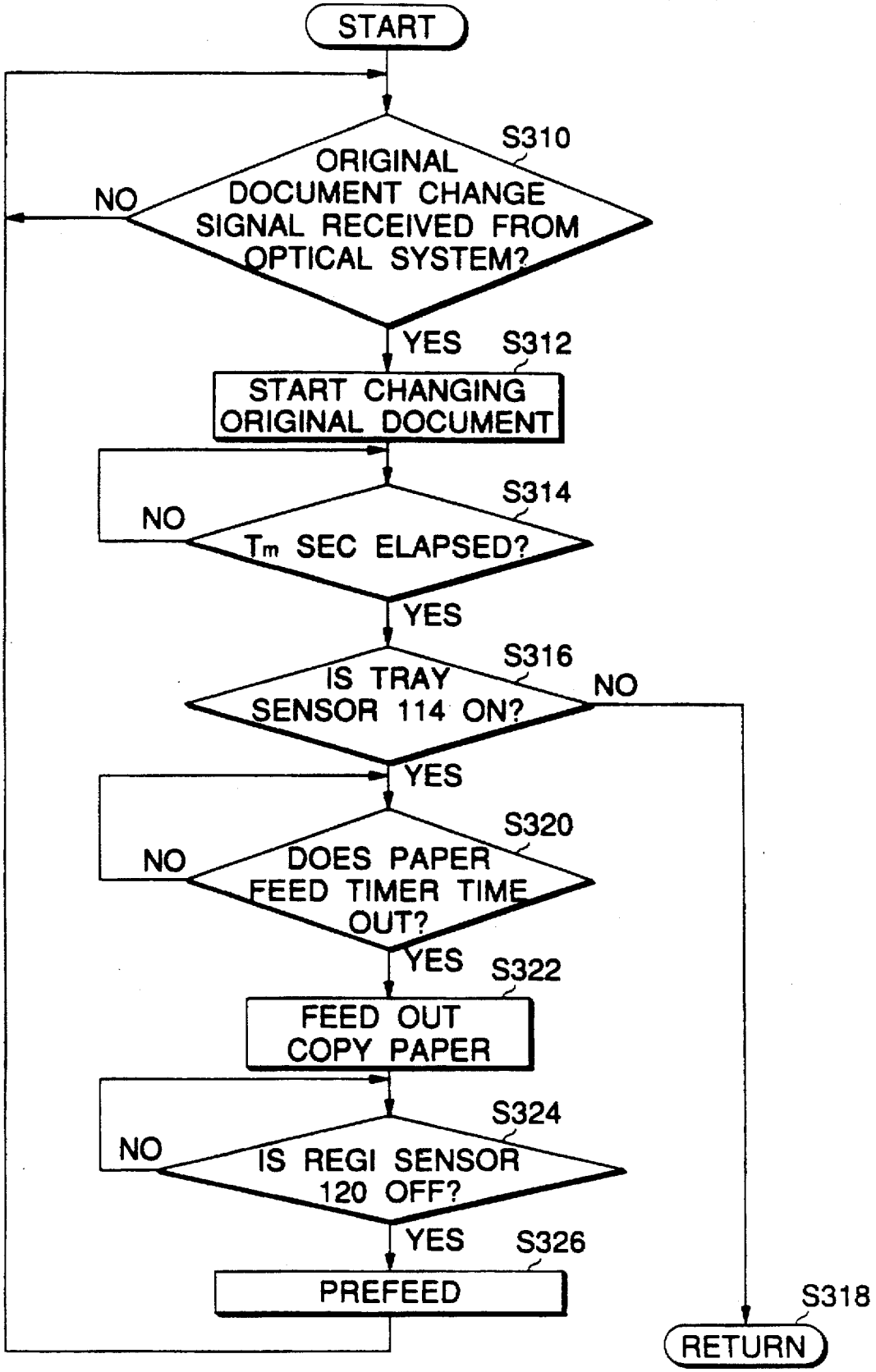
FIG. 5 is a flowchart to show details of a second previous paper feed process (S130) in FIG. 2.
Figure 6:
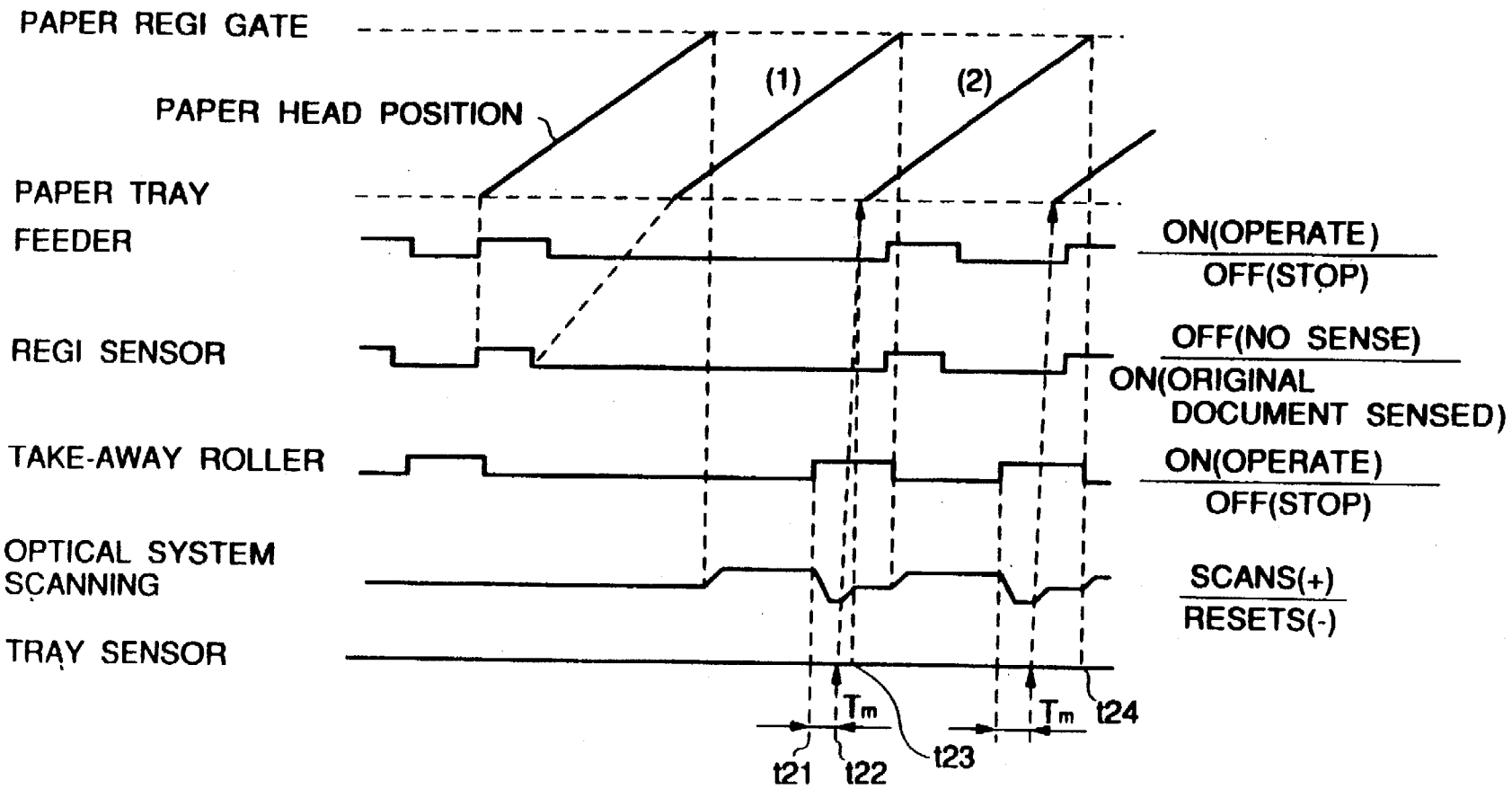
FIG. 6 is an illustration to show copy paper feed timing when the second paper feed process is executed.

FIG. 5 shows details of the second previous paper feed process. FIG. 6 shows the copy paper feed timing when the second previous paper feed process is executed. A wait is made for an original document change signal to come from the optical system 200 at step S310 and the take-away roller 110 starts transporting an original document to the platen glass 204 at step S312 (t21). After a lapse of Tm sec (a margin added to the time between the instant when transporting the original document is started and the instant when the original document turns off the tray sensor 114) at step S314, the tray sensor 114 senses whether or not the next original document exists at step S316 (t22). If the next original document does not exist, control returns at step S318. If the next original document exists, a wait is made for the paper feed timer to count a predetermined value at step S320, copy paper is fed out at step S322 (t23).

B. The transport distance until an original document leaves the tray sensor is found by subtracting the distance between the regi sensor and the tray sensor from the original document length of each original document that can be sensed. The transport distance divided by the transport speed (transport time)+margin is previously stored in a table.

Transport Time Table

| Original | Transport time + margin (Tm sec) |
|---|---|
| A4SEF | 160 |
| B5SEF | 90 |
| A5SEF | 50 |
| A5LEF | 0 |

C. When an original document is transported more than the transport distance, the tray sensor senses the original document.

If original document is transported for the transport time corresponding to the original document of the length sensed, the original document passes through the tray sensor, thus the tray sensor senses the next original document.

Thus, before original document prefeed is started, the next original document can be sensed. The second original document sheet can be sensed fast and a copy paper sheet can be previously fed fast. Thus, the copy paper sheet arrives at the regi gate 360 by the time the take-away roller 110 transports the original document onto the platen glass 204 (t24), wherein a copy can be made without producing the wait time in the paper transport section. When the original document moves to the platen glass 204 and the regi sensor 120 goes off at step S324, the next original document is prefed, step S326.

Even if copy paper does not arrive at the regi gate 360 by the time an original document is transported onto the platen glass 204, the second original document sheet is detected fast and copy paper is previously fed, wherein the copy cycle can be speeded up more than was formerly possible.

3.2 Paper feed start time when tray 1 is selected:

If tray 3–5 is not selected at step S90 or S100, control goes to step S140. If the operator specifies tray 2 at step S140 or if tray 2 is selected based on the original document size at step S150, control goes to step S160. If tray 2 is not selected at step S140 or S150, tray 1 is selected and control goes to the third previous paper feed process (S180).

Figure 7:
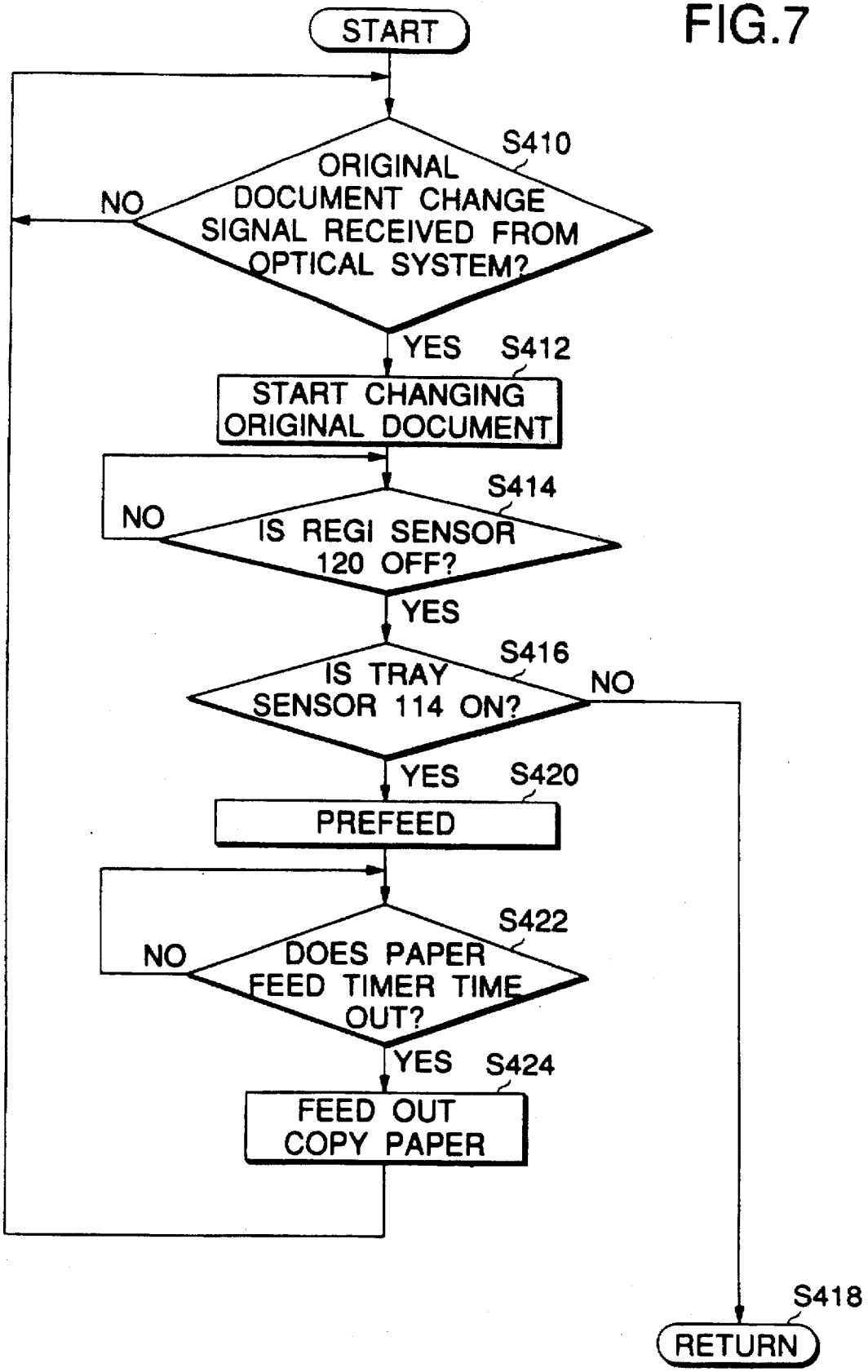
FIG. 7 is a flowchart to show details of a third previous paper feed process (S180) in FIG. 2.

FIG. 7 shows details of the third previous paper feed process. A wait is made for an original document change signal to come from the optical system 200 at step S410 and original document change is started at step S412. When the regi sensor 120 goes off (S414) and tray sensor 114 is on (S416), prefeed is started at step S420. When the optical system 200 arrives at the optical system regi sensor 202, the paper feed timer starts counting. The next copy paper sheet is fed out at step S424, provided that the regi sensor 370 goes on and that the paper feed timer counts a predetermined value at step S422. If tray sensor 114 at step S416 is not on, control returns at step S418.

When the original document set sensor 102 senses an original document, copy paper can also be previously fed. However, if a jam occurs during prefeeding, copy paper corresponding to the jammed original document must be discharged. To prevent this, output of the original document regi sensor 120 is used to previously feed copy paper. Since the distance from tray 1 to the regi gate 360 is short, a copy paper sheet corresponding to the second original document sheet arrives at the regi gate 360 by the time after the original document regi sensor 120 senses original document, the optical system 200 completes scanning and the automatic original document feeder 100 transports the original document onto the platen glass 204. Thus, the operation can be performed at the minimum time and the productivity does not lower.

3.3 Paper feed start time when tray 2 is selected:

If an original document whose scanning time by the optical system 200 is long, namely, a long original document is set on the original document tray, the scanning time of the optical system 200 is long. Thus, copy paper arrives at the regi gate 360 from the tray 2 by the time after original document arrives at the original document regi sensor 120, the optical system 200 completes scanning and the original document is transported onto the platen glass 204. Then, if an original document longer than a predetermined value is set on the original document tray at step S160, control goes to the third previous paper feed process (S180) and transport of the next copy paper sheet is started, provided that the paper feed timer has counted a predetermined value and that output of the original document regi sensor 120 is on.

Since the distance from the tray 2 to the regi gate 360 is slightly longer than that from the tray 1 to the regi gate 360, when an original document of the size whose scanning time by the optical system 200 is short, such as an A4LEF or B5LEF original document, is copied, copy paper does not arrive at the regi gate 360 by the time the original document, which arrives at the regi sensor 120, is transported onto the platen glass 204. Therefore, if a copy paper sheet is fed out after the regi sensor 120 goes on, the optical system 200 waits for the copy paper sheet to come, worsening productivity. To prevent the productivity from being worsened, it is necessary to sense the next original document fast and previously feed copy paper. Then, if an original document whose scanning time by the optical system 200 is short is set on the original document tray at step S160, control goes to the following fourth previous paper feed process (S170).

Figure 8:
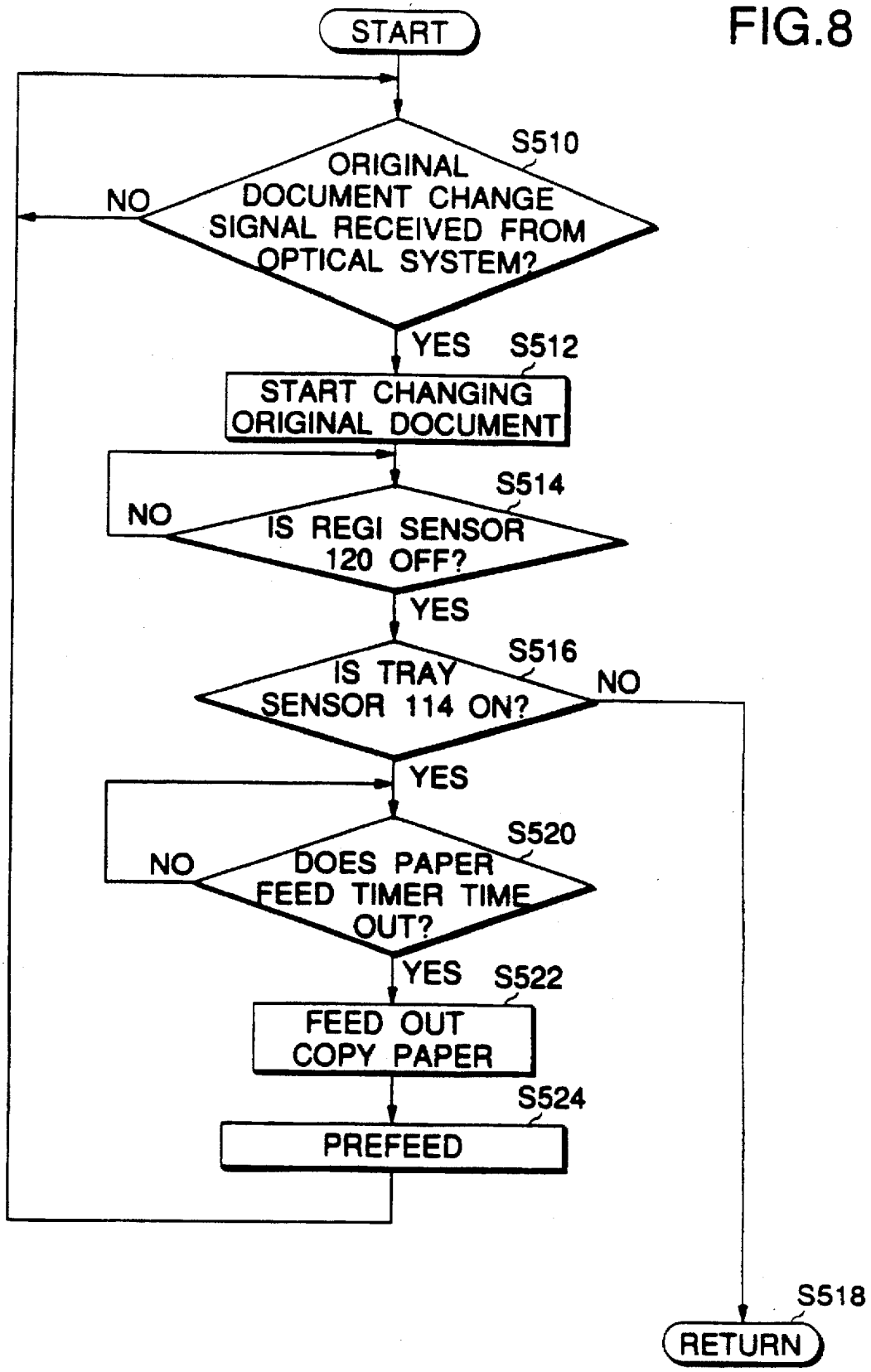
FIG. 8 is a flowchart to show details of a fourth previous paper feed process (S170) in FIG. 2.

FIG. 8 shows details of the fourth previous paper feed process. When an original document change signal comes from the optical system 200 at step S510, original document change is started at step S512. When the rear end of an original document passes through the regi sensor 120, namely, when the regi sensor 120 goes off at step S514, the tray sensor 114 senses the second original document sheet at step S516. Since the first original document sheet already passes through the original document regi sensor 120, the possibility that an original document jam will cause a copy paper sheet to become redundant is small. Although either the original document set sensor 102 or the tray sensor 114 can sense the second original document sheet, the tray sensor 114 is used to be shared with another operation sequence. If output of the tray sensor 114 is off at step S516, control returns at step S518. When a copy paper sheet arrives at the copy paper sensor 316, the paper feed timer starts counting. Transport of the next copy paper sheet is started at step S522 according to AND logic of the fact that the second original document sheet exists at step S516 and the fact that the paper feed timer has counted a predetermined value at step S520, resulting in prefeed S524.

Since the distance from the tray 2 to the regi gate 360 is shorter than that from the tray 3, 4, or 5 to the regi gate 360, even after the rear end of an original document passes through the original document regi sensor 120, the next copy paper sheet arrives at the regi gate 360 by the time the optical system 200 completes scanning and the automatic original document feeder 100 transports the original document onto the platen glass 204. Thus, the operation can be performed at the minimum time and the productivity does not lower.

3.4 Paper feed start time when tray sensor 114 does not normally operate:

The tray sensor 114, which is disposed at a position prone to be affected by the outside, easily abnormally operates due to an operator mistake, outer irregular light, etc. It can also be broken due to shock, etc. In this case, if the tray sensor 114 is used to previously feed copy paper, unnecessary copy paper may be previously fed or copy paper may be unable to be previously fed. Then, if output of the tray sensor 114 does not change at all by the time a copy using the automatic original document feeder is started after the copier power is turned on, the tray sensor 114 is determined to be abnormal. In this case, output of the regi sensor 370 is used to previously feed copy paper as with the case where the tray 1 is used.

When an original document is set on the original document tray, if the original document set sensor 102 senses the original document and the tray sensor 114 does not sense it, output of the regi sensor 370 is also used to previously feed copy paper as with the case where the tray 1 is used, wherein an original document can be copied not only when the tray sensor 114 is abnormal, but also when a small-size original document that cannot be sensed by the tray sensor 114 is set.

Although the invention has been described in its preferred form with a certain degree of particularity, it is understood that the present disclosure of the preferred form has been changed in the details of construction and the combination and arrangement of parts may be resorted to without departing from the spirit and the scope of the invention as set out in the accompanying aspects.

As seen from the description, according to the invention, the original document sensing method is controlled based on the length of an original document transport passage or the length of an original document, so that when the original document transport passage is long or the original document is short, the original document can be sensed fast. Thus, even to make a copy out of a 1-sheet original document, copy paper can be previously fed fast for enhancing the productivity.

According to the invention, if the original document transport passage is short or the original document is long, the original document sensing timing can be delayed. This can reduce the probability that an original document jam will cause previously fed copy paper to be wasted.

What is claimed is:

1. An image formation apparatus comprising:

a scanning means for scanning an image of an original document;

an image transfer means for transferring an image of a scanned original document to a copy paper sheet;

an original document tray for placing the original document;

a paper tray for storing the copy paper sheet;

a tray sensor for sensing the original document placed on said original document tray;

means for transporting the original document to said scanning means;

a regi sensor for measuring a length of the original document when the original document is transported to said scanning means;

means for storing a value corresponding to a transport distance until the original document leaves said tray sensor based on the length of the original document;

means for sensing the original document by said tray sensor when the original document is transported more than the transport distance corresponding to the value stored in said storage means; and means for feeding out the copy paper sheet to said image transfer means from said paper tray when said sensing means senses the original document.

2. The image formation apparatus of claim 1, further comprising:

means for prefeeding the original document on the original document tray to a point before said scanning means;

means for determining whether or not the original document has a size covering said tray sensor when the original document is prefed, based on the length of the original document; and means for sensing the original document by said tray sensor after the original document is prefed if the prefed original document has a size not covering said tray sensor.

3. The image formation apparatus of claim 2, further comprising:

means for sensing the original document by said tray sensor after starting transporting the prefed original document to said scanning means, if three original document sheets cannot be fed between said paper tray and said image transfer means.

4. The image formation apparatus of claim 1, further comprising:

means for feeding out the copy paper sheet when said regi sensor senses the original document, if the original document is a small-size original document that cannot be sensed by said tray sensor.

5. An image formation apparatus comprising:

a scanning means for scanning an image of an original document;

an image transfer means for transferring a scanned image of an original document to a copy paper sheet;

an original document tray for placing the original document;

a paper tray for storing the copy paper sheet;

a tray sensor for sensing the original document placed on said original document tray; and means for transporting the original document to said scanning means, wherein the original document is sensed based on relationship between a position of said tray sensor and sensing timing of said tray sensor.

6. An image formation apparatus comprising:

a scanning means for scanning an image of an original document;

an image transfer means for transferring a scanned image of an original document to a copy paper sheet;

an original document tray for placing the original document;

a paper tray for storing the copy paper sheet;

a tray sensor for sensing the original document placed on said original document tray;

means for transporting the original document to said scanning means;

tray sensor monitor means for monitoring whether or not output of said tray sensor changes between the instant when power is turned on and the instant when a copy is started; and transport control means for setting transport timing of said transport means without being concerned with output of said tray sensor if output of said tray sensor does not change at all between the instant when power is turned on and the instant when a copy is started, or for setting transport timing of said transport means based on output of said tray sensor if output of said tray sensor changes between the instant when power is turned on and the instant when a copy is started.

7. An image formation apparatus comprising:

a scanning means for scanning an image of an original document;

a plurality of paper trays for storing copy paper;

an image transfer means for transferring a scanned image of a first original document to a first copy paper;

a plurality of transport passages for transporting copy paper from said plurality of paper trays to said image transfer means;

means for selecting a first paper tray from said plurality of paper trays said first paper tray being associated with a first transport passage having an absolute length that is determined by a position of said first paper tray;

an automatic original document feeder for detecting as many original document sheets as a number of sheets of copy paper existing in said first transport passage; and said automatic original document feeder further comprising means for measuring a length of said first original document, and wherein a number of original document sheets is determined based on the absolute length of said first transport passage and the length of said first original document.

* * * * *